United States Patent [19]

Lecce et al.

[11] 4,112,530

[45] Sep. 12, 1978

[54] CAMPING TOOL, IN PARTICULAR FOR DRIVING AND EXTRACTING FROM THE GROUND ANCHORAGE PEGS OF CAMPING TENTS

[75] Inventors: Giovanni Lecce, Milan; Paolo Andena, Lodi, both of Italy

[73] Assignee: Leyan S.r.l., Milan, Italy

[21] Appl. No.: 780,066

[22] Filed: Mar. 22, 1977

[51] Int. Cl.[2] ..... B66F 15/00

[52] U.S. Cl. ..... 7/146; 7/166; 254/132

[58] Field of Search ..... 7/8, 8.1 R, 8.1 A, 9, 7/12; 254/30, 25, 26, 131, 132

[56] References Cited

U.S. PATENT DOCUMENTS

| | | | |
|---|---|---|---|
| 886,987 | 5/1908 | Kiehle | 254/25 |
| 960,193 | 5/1910 | Peterson | 254/25 |
| 2,994,510 | 8/1961 | Michalak | 254/132 |
| 3,208,724 | 9/1965 | Vaughan | 254/26 R |
| 3,867,733 | 2/1975 | Verlander | 254/132 |

*Primary Examiner*—Robert C. Watson

*Attorney, Agent, or Firm*—Max Fogiel

[57] ABSTRACT

A camping tool in which an elongated metallic body carries, at one end, a curved portion having a V-shaped gap. A handle is attached to the other end of the base body. A mass metallic portion is supported by the base body in proximity where the curved portion joins the elongated body. A ring-shaped member with a projection thereon, is pivotally connected to the base body between the mass portion and the handle.

3 Claims, 3 Drawing Figures

FIG. 1
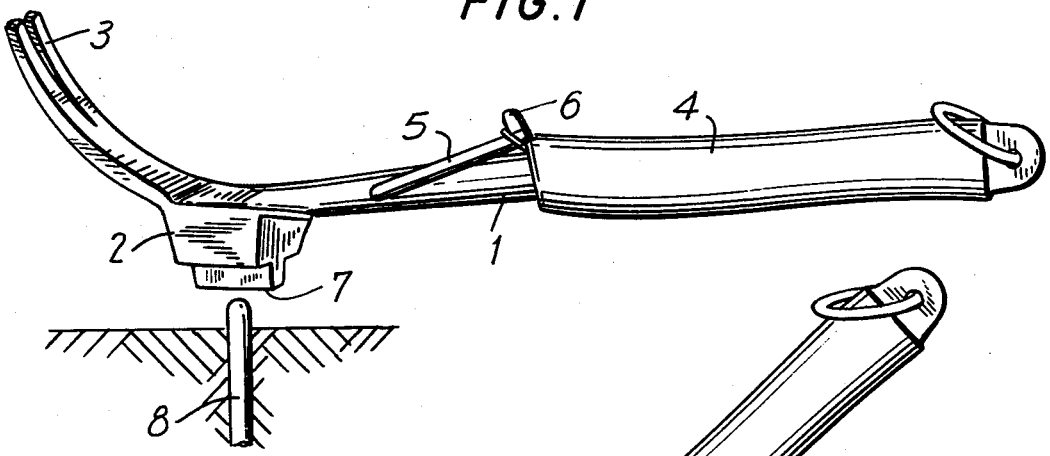
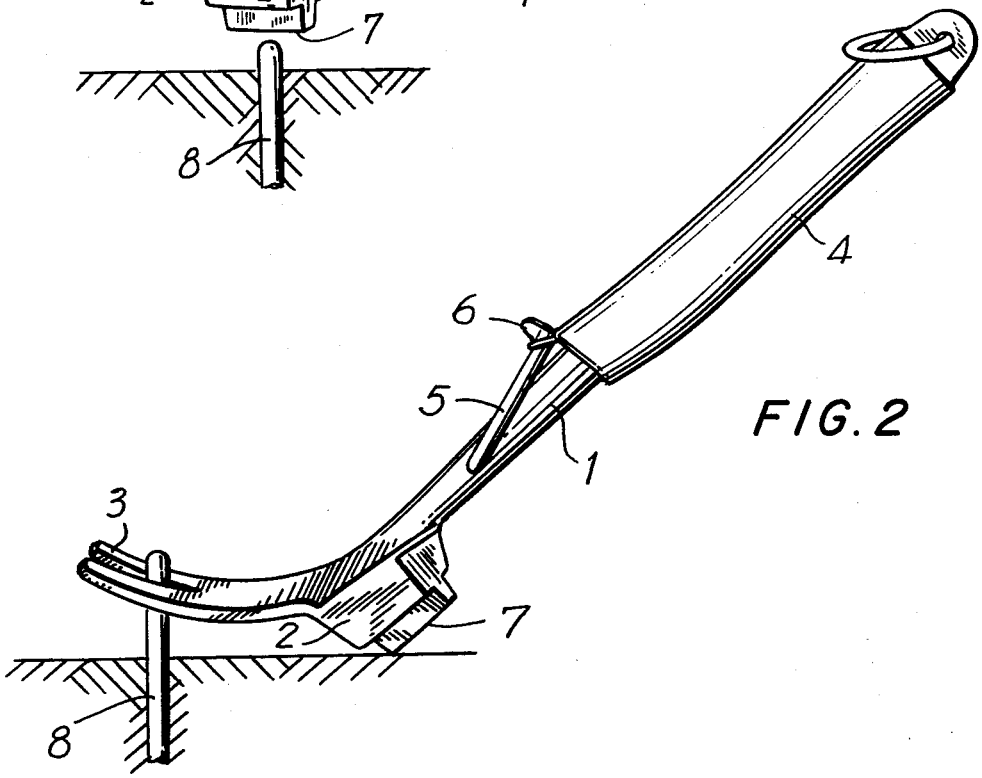
FIG. 2
FIG. 3
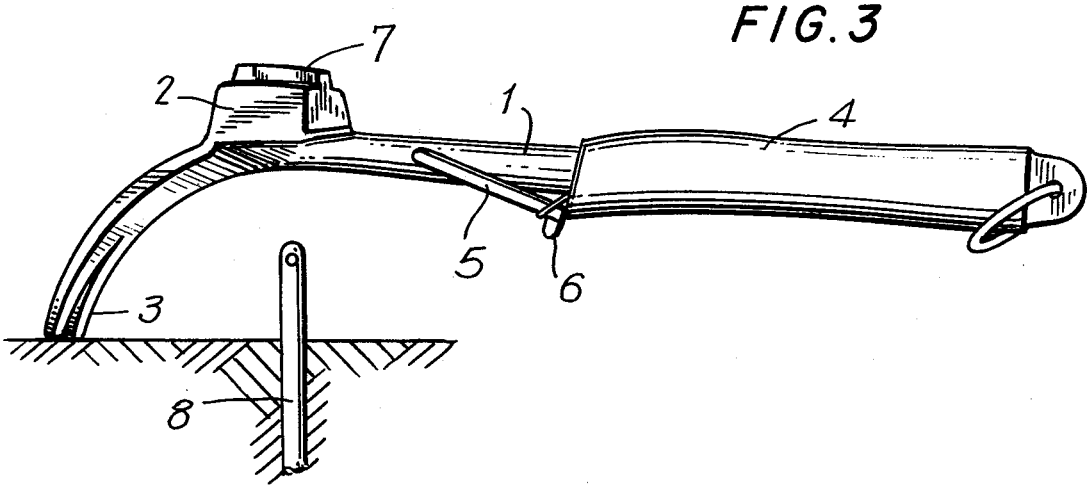

CAMPING TOOL, IN PARTICULAR FOR DRIVING AND EXTRACTING FROM THE GROUND ANCHORAGE PEGS OF CAMPING TENTS

BACKGROUND OF THE INVENTION

The present invention relates to a tool created especially in order to meet the basic requirement of campers, —requirement of mounting and disassembly of tents.

Mounting of a tent has to be made with great care in view of severity of storms, beginnings of storms and poor weather. As known in the art, a camping tent is simply a provisional refuge extremely exposed and dangerous if not well anchored to the ground by well secured means, well oriented, and absolutely resistant against blowing of the wind.

The means are constituted of pegs driven into the ground, which have to meet also a hard ground, not subjected to water infiltrations and uniformly hard in depth. The pegs, or nails, have to secure an undiscussed holding, they have to be driven wholly in the ground by using a well adapted means overcoming the resistance of the ground. The better the driving operation of the pegs has been made, the more laboriously will be the extraction of these at the time of disassembly of the tent.

For carrying out the two operations above, it is usual to make use of common tools or means, such as mallets or hammers to strike onto pegs or extractors engaging by hooking the pegs and facilitating the extraction.

SUMMARY OF THE INVENTION

The present invention has the scope to realize in a sole tool all the elements requested for executing the various operations and adapt each one of the elements to the operation to be realized so that it may be executed in the best manner and with the lowest fatigue.

The tool, in a general line, is conceived in the form of a lever used by the hands and having, at one end, the grip or handle, while the other end holds the curved, biforked extractor, and on the back of the extractor a striking mass, rather heavy for acting with strike on the pegs; on the backside of the mass, the tool supports also an engaging ring for hooking and final extraction of the peg after it has been given a vigorous jerking, during the first phase by the biforked extractor.

The tool at the same time is a mallet and a biforked lever for forced extraction.

The mallet realizes well the function of a hammer and may be used for striking pegs and nails in the ground and in wood.

The biforked lever, engaging itself under the top of pegs or nails, and receiving an opportune point of support or fulcrum near the mallet, in a first grade lever acts as goat foot producing a relevant extraction force. It is possible to operate following two steps: firstly by the lever so as to overcome the large initial resistance, and then for extraction by hooking the ring placed on the handle.

In the enclosed design the tool is clearly illustrated only to describe well the concept of the invention, without limiting its field of realization.

BRIEF DESCRIPTION OF THE DRAWINGS

FIG. 1 represents the tool disposed for operation for use as mallet or hammer;

FIG. 2 represents the same object as FIG. 1 disposed for its operation as first grade lever viz. as goat foot;

FIG. 3 is the same object as the above figures, but turned over with respect to these figures viz. disposed for use as second grade lever, with its fulcrum located near the fork of point, viz at the opposite end of that of the handle.

DESCRIPTION OF THE PREFERRED EMBODIMENTS

The tool is constituted by a metallic prolongated body 1, supporting a mass 2 joined to a point fork 3; on the opposite side of the point is located an operating handle 4. It is obvious that this is a mallet and an extractor with unificated lever, conceived in a manner to work with the utmost efficacy and comfort.

On the handle 1 is hinged a turning ring 5 with a nib 6. With this ring (see FIG. 3) the peg 8 is to be hooked in order to operate the full extraction, after having, in a first mode, moved the peg as per FIG. 2. Due to the fact that there are in the market flat pegs with a transversal hole in the head, the nib 6 is provided in order to engage itself in the hole to actuate the extraction.

Within the mass 2, projecting lightly outwards, is incorporated an insert 7 of a non-metallic material, such as plastics, hard gum, wood, nylon, fibre; the insert functions as shock-absorber of the mallet, reducing and silencing the shocks. The insert having its convenient place of anchorage by the mass 2 may be replaced when worn out.

The handle 4 is covered with a convenient material such as thermoplastic material, so as to be more comfortable when taken by the hand.

At the moment when the turning ring 5 is contacting the handle 4, in released position, it finds a stabilizer immobilizing it and preventing vibrations.

When observing the FIGS. 1 and 2 it is seen that the flat anterior end of the tool allows one to use the tool also as hoe or little spade.

We claim:

1. A camping tool, particularly for driving and extracting pegs for anchoring of tents on the ground, comprising: an elongated metallic body with a longitudinal axis; a curved portion at one end of said body and curved with respect to the longitudinal axis of said body; said curved body having a V-shaped gap with straight-lined edges forming the V-shaped, a mass portion at said one end of said body and located where said curved portion joins said elongated body for driving said pegs; a handle at the other end of said body for using and operating the tool; a ring-shaped member pivoted on said elongated metallic body for connecting hookingly with a peg for extracting the peg from the ground; and a projecting portion on said ring-shaped member for extending into a hole in a peg for extracting the peg from the ground.

2. A camping tool, particularly for driving and extracting pegs for anchoring of tents on the ground, comprising: an elongated metallic body with a longitudinal axis; a curved portion at one end of said body and curved with respect to the longitudinal axis of said body; said curved body having a V-shaped gap with straight-lined edges forming the V-shaped, a mass portion at said one end of said body and located where said curved portion joins said elongated body for driving said pegs; a handle at the other end of said body for using and operating the too; a ring-shaped member pivoted on said elongated metallic body for connecting hookingly with a peg for extracting the peg from the ground; and tooth means for holding said ring-shaped member against said handle when said ring-shaped member is not in use.

3. A camping tool, particularly for driving and extracting pegs for anchoring of tents on the ground, comprising: an elongated metallic body with a longitudinal axis; a curved portion at one end of said body and curved with respect to the longitudinal axis of said body; said curved body having a V-shaped gap with straight-lined edges forming the V-shaped, a mass portion at said one end of said body and located where said curved portion joins said elongated body for driving said pegs; a handle at the other end of said body for using and operating the tool; a ring-shaped member pivoted on said elongated body between said mass portion and said handle; a projection on said ring-shaped member for extending into an opening in a peg for extracting said peg from the ground; said handle having a covering of thermoplastic material; said mass portion being of metallic material and being integral with said elongated body; said mass portion having a non-metallic insert for driving a peg into the ground; and means on said other end of said elongated body for suspending said tool in storage when not using said tool.

* * * * *